US005944280A

United States Patent [19]

Dimitri

[11] Patent Number: 5,944,280

[45] Date of Patent: Aug. 31, 1999

[54] HAND CARRIED WIRE SPOOL RACK FOR DISPENSING WIRE AND METHOD OF MANUFACTURING SAME

[76] Inventor: Angelo S. Dimitri, 84 W. Garden Ave., Palatine, Ill. 60067

[21] Appl. No.: 08/910,635

[22] Filed: Aug. 13, 1997

[51] Int. Cl.[6] ..... B65H 16/02; B65H 18/02; B65H 49/00

[52] U.S. Cl. ..... 242/594.2; 242/588; 242/588.2; 242/595; 242/557; 242/129.7

[58] Field of Search ..... 242/588, 588.2, 242/588.3, 594.1, 594.2, 595, 595.1, 557, 129.7, 132, 137, 146

[56] References Cited

U.S. PATENT DOCUMENTS

| | | | |
|---|---|---|---|
| 849,066 | 4/1907 | Hahn | 242/594.2 |
| 991,827 | 5/1911 | Capers | 242/595 X |
| 1,130,591 | 3/1915 | Gray . | |
| 2,220,230 | 11/1940 | Gilbert | 242/595.1 X |
| 2,705,114 | 3/1955 | Worsham . | |
| 2,805,029 | 3/1957 | Fanning . | |
| 2,957,644 | 10/1960 | Beardslee . | |
| 3,134,555 | 5/1964 | Baker . | |
| 3,383,071 | 5/1968 | Godson . | |
| 4,039,157 | 8/1977 | Arriola, Jr. | 242/595.1 X |
| 4,827,818 | 5/1989 | Stringfellow . | |
| 4,978,085 | 12/1990 | Letourneau | 242/595.1 X |
| 5,174,518 | 12/1992 | Hongo et al. | 242/595 X |
| 5,480,084 | 1/1996 | Daniels | 242/595 X |
| 5,499,727 | 3/1996 | Koch . | |
| 5,634,610 | 6/1997 | Walsh . | |
| 5,687,928 | 11/1997 | Lassiter | 242/588.2 X |

*Primary Examiner*—John Q. Nguyen
*Attorney, Agent, or Firm*—Mathew R. P. Perrone Jr.

[57] ABSTRACT

A hand carried wire spool rack for dispensing wire is disclosed. The rack includes a frame having a pair of horizontally extending parallel members for rotatably supporting at least one removable wire spool. The members are spaced apart by a distance that is less than the diameter of the spool. An upper member is secured to the frame and extends parallel with one of the parallel members. The upper member is positioned upwardly and outwardly from one of the parallel members. The wire spool is positionable in a first position in rotatable supported engagement with the pair of parallel members. The wire spool is movable to a second position in rotatable supported engagement with one of the parallel members and the upper member when a dispensing force is exerted on the wire spool which is generally greater than the relative weight of the wire spool. A method of forming the rack is also disclosed.

7 Claims, 2 Drawing Sheets

HAND CARRIED WIRE SPOOL RACK FOR DISPENSING WIRE AND METHOD OF MANUFACTURING SAME

BACKGROUND OF THE INVENTION

1. Field of the Invention

The present invention relates generally to dispensing racks for spools of wire. More particularly, the invention pertains to an improved portable hand carried wire dispensing rack and method of manufacturing same.

2. Description of the Prior Art

In the prior art, various types of racks are known for dispensing spools or reels of wire or other extendible line type material such as wire, cable, rope, and the like.

One commonly used dispensing rack includes a horizontal axle upon which a series of wire spools are rotatably mounted. While such prior art dispensing racks may be provided within a portable frame to provide a convenient means for transporting the series of wire spools to a construction or job site, these devices suffer from a number of disadvantages.

First, in a dispensing rack which supports the series of wire spools on a common horizontal axle, replacement of any one spool requires removal of the axle in order to gain access to the spool being replaced. In the work environment, such assembly and disassembly of the rack leads to lost time and aggravation to the user. Second, the supporting of a wire spool with a axle extending through an axial hole of the spool facilitates unnecessary dispensing or entanglement of wire when a pulling or dispensing force on the wire spool is discontinued causing the wire spool to spin freely.

To solve some of the aforementioned problems, several attempts in the prior art are known. For example, U.S. Pat. No. 5,634,610 issued to Walsh discloses a portable wire dispenser having support members for supporting wire spools along outer circumferential edges of the spools. A rotatable member is engaged across the tops of the wire spools to retain the wire spools on the support members. However, where the rotatable member of Walsh extends horizontally across a plurality of wire spools, this device will not accommodate spools of varied size. Further, even within particular size classifications of industry standards of wire spools, it is known that the wire reels or spools made by different manufacturers can differ in diameter by ⅛ to ¼ inches.

As will be described in greater detail hereinafter, the dispensing rack and method of manufacturing of the present invention solves all of the aforementioned problems and employs a number of novel features that render it highly advantageous over the prior art.

SUMMARY OF THE INVENTION

Accordingly, it is an object of this invention to provide a wire dispensing rack for conveniently storing, transporting, and dispensing wire or cable from wire spools.

Another object of this invention is to provide a wire dispensing rack which may be hand carried by a user for easy transport and use, and which additionally allows for easy replacement of empty wire spools.

Another object of this invention is to provide a wire dispensing rack which prevents wire tangling caused by free spinning wire spools and which prevents wire spools from falling out should the rack be accidentally tipped over.

Another object of this invention is to provide a wire dispensing rack that is inexpensive and easy to manufacture.

The rack can be formed using inexpensive materials which provides a sturdy and durable construction.

Still another object of this invention is to provide a wire dispensing rack that allows an unfilled rack to be secured so that wire spools are not allowed to move laterally about from side to side, and which additionally allows the user to maintain a balanced weight distribution of the rack for ease in carrying.

Yet another object of this invention is to provide a wire dispensing rack that accepts wire spools of varied sizes or diameters.

To achieve the foregoing and other objectives, and in accordance with the purposes of the present invention a portable rack is provided for dispensing wire contained on spools. The rack includes a frame having a pair of horizontally extending parallel members for rotatably supporting at least one removable wire spool at outer circumferential edges of annular flanges of the wire spool. The members are spaced apart by a distance that is less than the diameter of the annular flanges. An upper member is secured to the frame and extends parallel with the parallel members. The upper member is positioned upwardly and outwardly, and spaced apart by a distance that is less than the diameter of the annular flanges, from one of the parallel members.

In operation, the wire spool is positionable in a first position with the annular flanges in rotatable supported engagement with the pair of parallel members. The wire spool is movable to a second position with the annular flanges in rotatable supported engagement with one of the parallel members and the upper member when a dispensing force is exerted on wire spool which is generally greater than the relative weight of the wire spool. A pair of lower rails lies in a common horizontal plane and is connected to the first pair of parallel members with transverse members. The pair of lower rails extend parallel to the first pair of parallel members and are spaced apart from one another greater than the distance between the first pair of parallel members. Each of the pair of lower rails is positioned downwardly, outwardly from one of the first pair of parallel members. The pair of lower rails is adapted for engaging the support surface. The pair of upper and lower rails and the first pair of parallel members are positioned across their cross-section in an hourglass shape, as shown in FIG. 4. The rack is supported against the support surface by one of the pair of lower rails and one of the pair of upper rails when tipped 90° in a direction perpendicular to axes of the pair of upper and lower rails with the one of the of upper rails forming a stop for engagement with the wire spool preventing the wire spool from falling out of the rack.

In accordance with a method of the invention, a method of forming a portable rack for dispensing wire is provided. The method includes the steps of: forming a length of a metal rod into a generally rectangular frame having a pair of horizontally extending parallel members for rotatably supporting at least one removable wire spool at outer circumferential edges of annular flanges of the wire spool; forming two lengths of metal rod into two generally rectangular side frames, opposite ends of each side frame having a curved portion; and mounting each side frame to opposite sides of the frame so that horizontally extending upper members of each side frame extend parallel with the parallel members, the upper members being spaced apart from one another a distance greater than the diameter of the annular flanges to form a top opening sized to receive the wire spool therethrough.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
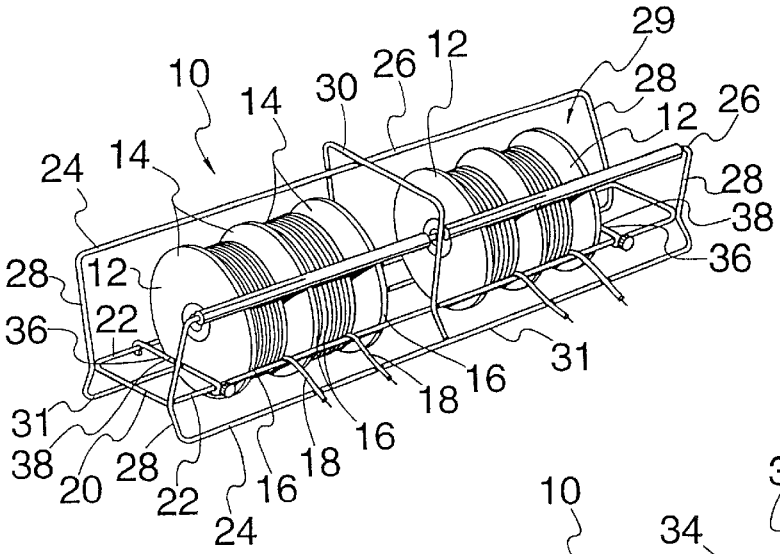
FIG. 1 is a perspective view of the present invention having a series of wire spools mounted thereon.

Referring now to the drawings, a portable rack 10 for dispensing wire is illustrated in FIG. 1. As will be described below, the rack 10 is adapted for supporting a series of wire spools or reels 12 in side by side adjacent relationship to one another. Each spool 12 has opposite annular flanges 14. Each flange 14 has outer circumferential edges 16. Typically, the spools 12 are purchased from various manufacturers having wire 18 wound thereabout. For purposes of this application, it should be understood that the term wire includes electrical wire and other extendible line type material such as cable, rope, and the like.

Referring to FIGS. 1–3 and 8, a generally rectangular frame 20 has a pair of horizontally extending parallel rods or members 22 for rotatably supporting the wire spools 12 at the outer circumferential edges 16 (FIG. 1). The members 22 are spaced apart by a distance that is less than the diameter of the annular flanges 14 of the spools 12 so that the spools are supported at points below the centermost points of the spool 12.

A pair of opposing rectangular side frames 24 each include an upper rod or member 26 secured to the frame 20 at opposite ends 28 of each side frame 24. The upper members 26 extend horizontal and parallel with the parallel members 22. Each upper member 26 is positioned upwardly and outwardly, and spaced apart by a distance that is less than the diameter of the annular flanges 14, from a respective one of the parallel members 22. The upper members 26 are spaced apart from one another a distance greater than the diameter of the annular flanges 14 to form a top opening 29 sized to receive the wire spools 12 therethrough. Accordingly, the spools 12 may be easily removed to replace empty spools by simply lifting the spool 12 upwardly through the opening 29. The side frames 24 further include lower rails 31 allowing the rack 10 slide laterally on a floor, such as when the rack 10 is slid into a vehicle for transportation.

Figure 6:
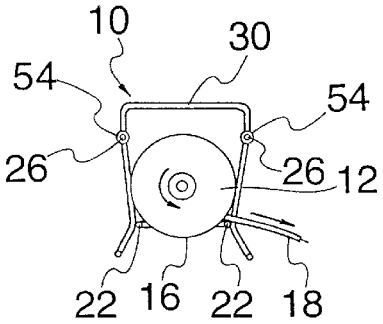
FIG. 6 is a sectional end view showing a wire spool in a first position.
Figure 7:
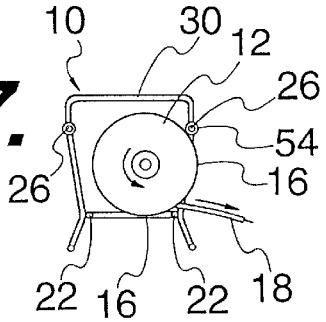
FIG. 7 is a sectional end view showing a wire spool in a second position.

The wire spool 12 is positionable in a first position, as illustrated in FIGS. 1 and 6, with the annular flanges 14 in rotatable supported engagement with the pair of parallel members 22. The wire spool 12 is movable to a second position, as illustrated in FIG. 7, with the annular flanges 14 in rotatable supported engagement with one of the parallel members 22 and one of the upper members 26 when a dispensing force is exerted on the wire spool 12 which is generally greater than the relative weight of the wire spool 12.

The dispensing force is created by a user pulling on the wire 18 causing the wire spool 12 to rotate on the members 22. The friction created between the members 22 and edges 16 of the flanges 14 prevents undesired free spinning of the spool 12 when a force is discontinued. When the spool 12 is heavy, such as when the spool is more than half full of wire 18, the weight of the spool 12 keeps the spool 12 in rotatable engagement with the members 22 during dispensing. In the case of a lighter spool 12, such as when the spool 12 is less than half full of wire 18, the dispensing force can cause movement of the spool 12 to the second position, as previously described.

Figure 2:
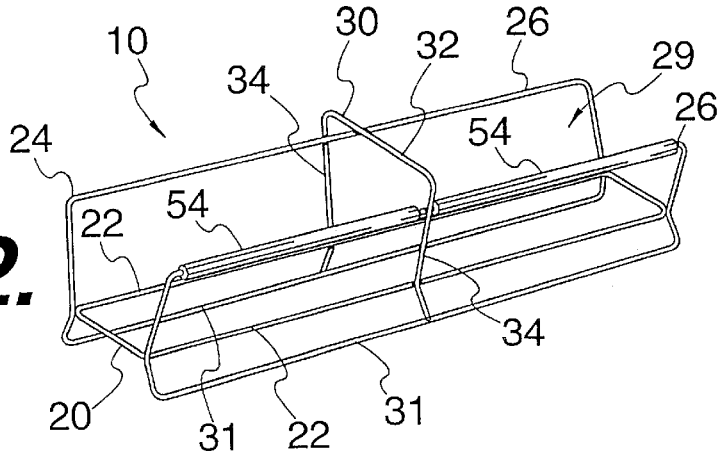
FIG. 2 is a perspective view of the present invention.
Figure 3:
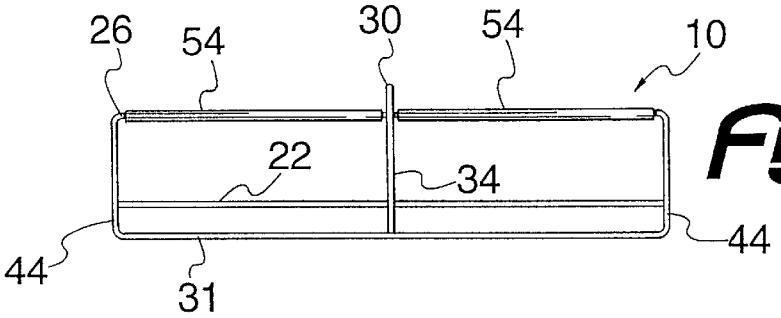
FIG. 3 is a side view of the present invention.

Referring to FIG. 2, a handle structure 30 is connected to the rack 10 to allow the rack 10 to be hand carried by a single user to facilitate easy transportation. The handle structure 30 is generally U-shaped and includes a generally horizontal top member 32 extending perpendicular of the parallel members 22. Downwardly extending side members 34 of the structure 30 are secured to the parallel members 22 and the upper members 26 at a midpoint thereof to also provide structural support to the rack 10.

Figure 8:
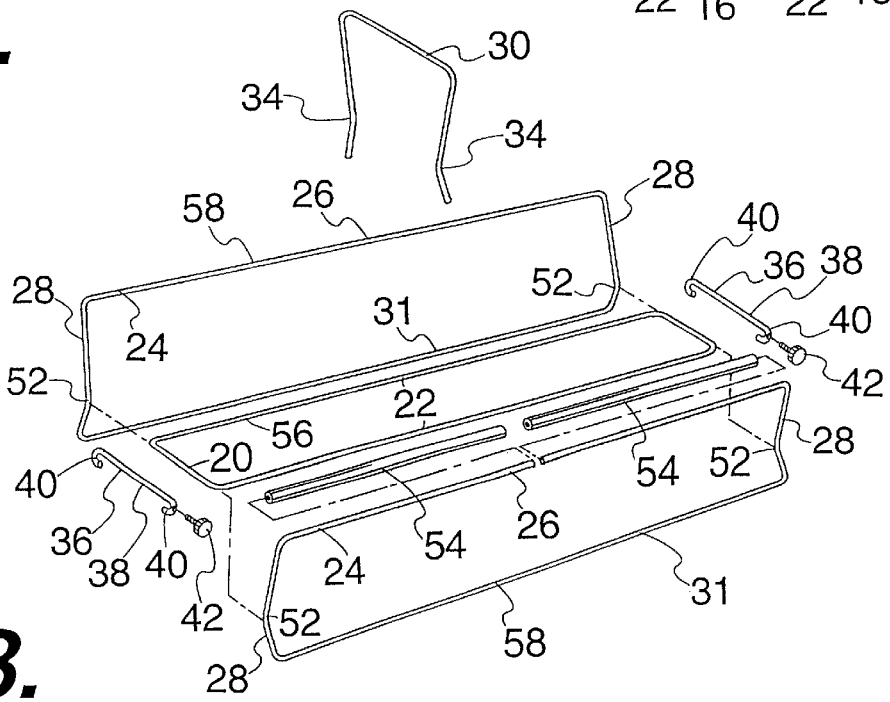
FIG. 8 is an exploded perspective view of the present invention.

Referring to FIGS. 1 and 8, retainer assemblies 36 are provided for adjustable connection with the rack 10 for preventing lateral movement of the wire spools 12 along the pair of parallel members 22. Each retainer assembly 36 includes a retainer member 38 having opposite U-shaped ends 40 for engagement with the parallel members 22 and extending perpendicular therebetween. A thumb screw 42 is operatively connected in threaded engagement at one end 40 for manually and adjustably connecting the retainer member 38 with the parallel members 22. Each retainer member 38 is in adjacency to respective outer facing annular flanges 14 of opposite outermost wire spools 12 for preventing lateral movement of the wire spools 12 and maintaining a balanced weight distribution of the rack 10.

Figure 4:
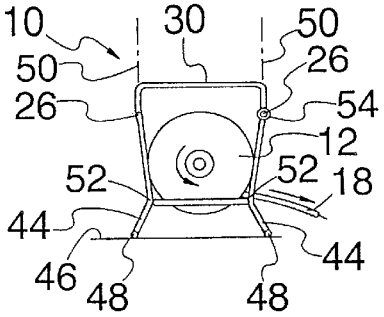
FIG. 4 is an end view of the present invention showing a wire spool.
Figure 5:
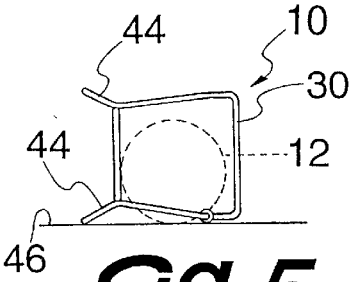
FIG. 5 is an end view of the present invention tipped on its side.

Referring to FIGS. 4 and 5, the rack 10 has lower frame members 44 connected therewith for supporting the pair of parallel members 22 a spaced apart distance from the floor 46. The lower frame members 44 preferably extend downwardly outwardly from each of the parallel members 22 to prevent tipping or tilting of the rack 10. An outermost portion 48 of each lower frame member 44 lies in a common vertically oriented plane 50 with respective upper members 26. The configuration as described including the opposite ends 28 of each side frame 24 having curved or bent portions 52 provides an especially sturdy rack 10. However, should the rack 10 become tipped over, as illustrated in FIG. 5, it should be noted that the spools 12 are prevented from falling out of the rack 10.

Preferably, at least one of the upper members 26 has a cylindrically shaped sleeve 54 freely rotatable thereon. The sleeve 54 reduces rotation friction of the spool 12 when rotating in the second position. As shown in FIG. 6, both members 26 are provided with sleeves 54.

In accordance with a method of the invention, a method of forming the portable rack 10 is provided. It is significant to note that the rack 10 may be manufactured with inexpensive steel rod materials and in a manner requiring less costs than known prior art dispensing racks. Referring to FIGS. 1 and 8, the method includes the steps of: forming a length of a metal rod 56 into the generally rectangular frame 20, as previously described; forming two lengths of metal rod 58 into the two generally rectangular side frames 24 and bending opposite ends of each side frame 24 to form the curved portions 52; and mounting each side frame 24 to opposite sides of the frame 20 to form the top opening 28 sized to receive the wire spool therethrough. Preferably, the frames 20, 24 and metal handle structure 30 are welded together.

The step of forming the two generally rectangular side frames 24 preferably includes the of step inserting the cylindrically shaped sleeve 54 on the upper member 26 of at least one the side frames 24 with the sleeve 54 being freely rotatable thereon.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A portable rack for dispensing wire contained on spools, the rack resting on a support surface when not in transport, the rack comprising: a rigid base comprising an elongate first pair of parallel rod members, said first pair of members comprising a first piece and a second piece, wherein each of the first and second pieces have first and second ends, the base further comprising an elongate second pair of rod members which extends perpendicular to the first pair at said first and second ends so as to form a rectangle within a first plane for rotatably supporting at least one removable wire spool at outer circumferential edges of annular flanges of the wire spool, the first pair of parallel members being spaced apart by a distance that is less than the diameter of the annular flanges, a pair of upper members extending parallel to said first pair of parallel members, each upper member being positioned upwardly and outwardly, and spaced apart from said first and second pairs of parallel members by a distance that is less than the diameter of the annular flanges and being secured to the midpoint of said first piece of said first pair of pair of parallel members by means of a first transverse rod which extends out of said first plane, the upper members being spaced apart from one another a distance greater than the diameter of the annular flanges to form a top opening sized to receive the wire spool therethrough, the wire spool being positionable in a first position with the annular flanges in rotatable supported engagement with the first pair of parallel members, the wire spool being movable to a second position with the annular flanges in rotatable supported engagement with said first piece of the first pair of parallel members and one of the upper members when a dispensing force is exerted on wire spool which is generally greater than the relative weight of the wire spool, a pair of lower rails lying in a common horizontal plane and connected to the first pair of parallel members with transverse members, the pair of lower rails extending parallel to said first pair of parallel members, the pair of lower rails being spaced apart from one another greater than the distance between said first pair of parallel members, each of the pair of lower rails being positioned downwardly, outwardly from one of the first pair of parallel members, the pair of lower rails being adapted for engaging the support surface, the pairs of upper members and lower rails and the first pair of parallel members being positioned in cross-section in an hourglass shape, the rack being supported against the support surface by one of said pair of lower rails and one of said pair of upper members when the rack is tipped 90° in a direction perpendicular to axes of said pairs of upper members and lower rails with said one of said of upper members forming a stop for engagement with the wire spool preventing the wire spool from falling out of the rack.

2. The portable rack of claim 1, further comprising handle means connected to the base to allow the rack to be hand carried by a single user to facilitate easy transportation.

3. The portable rack of claim 2, wherein the handle means includes a generally horizontal top member extending from said first transverse rod in a second plane which is parallel to said first plane, said handle means extending between said first transverse rod and a second transverse rod, said second transverse rod being secured to a midpoint of said second piece of said first pair of parallel members and to a midpoint of one of the upper members to provide structural support to the rack.

4. The portable rack of claim 1, further comprising retainer means adjustably connected with the base for preventing lateral movement of the wire spool along the first pair of parallel members wherein the retainer means includes a retainer member adjustably connected to the first pair of parallel members and extending perpendicular therebetween.

5. The portable rack of claim 4, wherein the retainer member includes a thumb screw operatively connected therewith at one end for manually and adjustably connecting the retainer member with the first pair of parallel members.

6. The portable rack of claim 1, wherein an outermost portion of each lower rail lies in a common vertically oriented third plane with one of the upper members.

7. The portable rack of claim 1, wherein at least one of the upper members has a cylindrically shaped sleeve freely rotatable thereon.

* * * * *